United States Patent [19]

Fujita

[11] Patent Number: 4,590,150

[45] Date of Patent: May 20, 1986

[54] METHOD FOR PROCESSING SILVER HALIDE COLOR PHOTOGRAPHIC LIGHT-SENSITIVE MATERIAL

[75] Inventor: Yoshihiro Fujita, Kanagawa, Japan

[73] Assignee: Fuji Photo Film Co., Ltd., Kanagawa, Japan

[21] Appl. No.: 759,809

[22] Filed: Jul. 29, 1985

[30] Foreign Application Priority Data

Jul. 27, 1984 [JP] Japan ..... 59-158475

[51] Int. Cl.[4] ..... G03C 7/40; G03C 5/24

[52] U.S. Cl. ..... 430/372; 430/393; 430/432; 430/428; 430/463

[58] Field of Search ..... 430/372, 432, 463, 428, 430/430, 393

[56] References Cited

U.S. PATENT DOCUMENTS

| | | | |
|---|---|---|---|
| 3,306,746 | 2/1967 | Schwartz | 430/966 |
| 3,761,262 | 9/1973 | Schranz et al. | 430/372 |
| 4,336,324 | 6/1982 | Koboshi et al. | 430/463 |

*Primary Examiner*—Mary F. Downey

*Attorney, Agent, or Firm*—Sughrue, Mion, Zinn, Macpeak and Seas

[57] ABSTRACT

A method for continuously development processing an imagewise exposed silver halide color photographic light-sensitive material, comprising the use in a washing step or stabilization step subsequent to bleaching and fixing steps or a bleach-fixing step of at least one compound represented by formula (I)

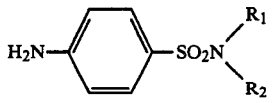

(I)

wherein $R_1$ and $R_2$ each represents a hydrogen atom, an alkyl group, a substituted alkyl group, an aryl group, a substituted aryl group, or a nitrogen-containing heterocyclic group. In accordance with the present method, the stability of the washing water or stabilizer can be greatly increased without deteriorating the stability of dye images; particularly, the formation of floating matter and precipitates in the washing water or stabilizer can be substantially prevented.

9 Claims, No Drawings

METHOD FOR PROCESSING SILVER HALIDE COLOR PHOTOGRAPHIC LIGHT-SENSITIVE MATERIAL

FIELD OF THE INVENTION

The present invention relates to a method for processing a silver halide color photographic light-sensitive material. More particularly, it is concerned with a processing method whereby the amount of water used, in a washing step, for example, can be greatly reduced.

BACKGROUND OF THE INVENTION

Methods for development processing a silver halide photographic light-sensitive material usually includes washing and stabilization steps. In recent years it has been increasingly desired to decrease the amount of water used in such methods from the viewpoints of the protection of the environments, the conservation of water resources, and the reduction of production costs. For example, S. R. Goldwasser, *Water Flow Rates in Immersion-Washing of Motion Picture Film,* SMPTE, Vol. 64, pp. 248–253 (May 1955) discloses a method for reducing the amount of water used by countercurrently passing the water through a plurality of washing tanks. This method is employed in various automatic developing machines as an effective means for the reduction of water. It has been revealed, however, that the method suffers from several disadvantages. The main disadvantage is that various precipitates and floating matter are formed in the water, because the water becomes very unstable when contaminated with iron ions from the bleaching step and thiosulfates from the fixing step during the processing, and, furthermore, if the amount of water used is greatly decreased, its residence time is inevitably lengthened.

The above problem also arises in the case that the washing step is replaced by a stabilization step, and also in the case that a washing step is followed by a stabilization step.

These precipitates and floating matter stick to the light-sensitive material, and cause the plugging or contamination of a filter of an automatic developing machine, thereby producing various problems.

In order to overcome the above problems, many methods of preventing precipitation have been proposed. For example, L. E. West, *Phot. Sci., and Eng.,* Vol. 19, No. 6 (1965), "Water Quality Criteria", discloses the addition of chelating agents and germicides. Japanese Patent Application (OPI) Nos. 8542/82, 105145/83, and 157244/82 (the term "OPI" as used herein means a "published unexamined Japanese patent application" disclose the addition of various antifungal agents such as thiazolylbenzimidazole compounds and isothiazolone compounds. These antifungal agents, however, are not satisfactory for practical use because of low solubility, poor safety, or insufficient effect in preventing the precipitation. A method involving adding various chelating agents is described, for example, in Japanese Patent Application (OPI) Nos. 8542/82, 58143/82, 132146/82, and 18631/83. These chelating agents, however, are not sufficiently effective, and, furthermore, exert adverse influences on the storage stability of images; in other words, they fail to produce satisfactory results. A method of using sulfites in combination with chelating agents is described in Japanese Patent Application (OPI) Nos. 97530/82, 88738/84, and 88739/84, but also in this case, the effect is not sufficiently satisfactory.

SUMMARY OF THE INVENTION

An object of the present invention is to increase the stability of washing water or a stabilizer solution (hereinafter referred to simply as the "stabilizer") without deterioration of the stability of dye images.

Another object of the present invention is to prevent the formation of precipitates and floating matter in the washing water or stabilizer.

A further object of the present invention is to increase the stability of the washing water or stabilizer itself without deterioration of the stability of dye images in the case that the amount of the washing water or stabilizer used is greatly decreased and also even in the case that the amount of the washing water or stabilizer being replenished is greatly decreased.

It has been found that the objects can be attained by using at least one compound represented by formula (I) as described hereinafter.

Accordingly, the present invention relates to a method for continuously development processing an imagewise exposed silver halide color photographic light-sensitive material, comprising the use in a washing step or stabilization step after bleaching and fixing steps or a bleach-fixing step of at least one compound represented by formula (I)

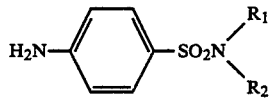

(I)

wherein $R_1$ and $R_2$ are each a hydrogen atom, an alkyl group, a substituted alkyl group, an aryl group, a substituted aryl group, or a nitrogen-containing heterocyclic group. Of course, $R_1$ and $R_2$ may be the same or different.

DETAILED DESCRIPTION OF THE INVENTION

The compounds of formula (I) are hereinafter explained in more detail.

In formula (I), the alkyl group preferably has from 1 to 10 carbon atoms, and more preferably from 1 to 5 carbon atoms. The total number of carbon atoms contained in the substituted alkyl group is preferably from 1 to 10, and more preferably from 1 to 5. Preferred substituents of the substituted alkyl group include a halogen atom, a hydroxyl group, an amino group, a sulfonic acid group, a nitro group, and a carboxyl group.

The aryl group includes a phenyl group and a naphthyl group. The substituent of the substituted aryl group includes a halogen atom, an alkyl group, an amino group, a sulfonic acid group, a nitro group, and a carboxyl group. The total number of carbon atoms in the aryl group or substituted aryl group is preferably from 6 to 16, and more preferably from 6 to 10.

The nitrogen-containing heterocyclic group includes a pyrazole group, an oxazole group, an isooxazole group, a thiazole group, an isothiazole group, a thiadiazole group, a pyridyl group, and a pyridazine group. These groups may be substituted by a substituent or substituents as described above.

$R_1$ and $R_2$ are each preferably a hydrogen atom, an alkyl group having from 1 to 5 carbon atoms, or a nitrogen-containing heterocyclic group which may be substituted.

The compounds of formula (I) can effectively depress the formation of precipitates and floating matter in the washing water or stabilizer without exerting adverse influences on the photographic characteristics, for example, without deteriorating the stability of dye images, or causing serious formation of stain. The compound are effective particularly for the washing water or stabilizer containing both iron ions and thiosulfates.

As a result of extensive investigations on the formation of precipitates in the washing water or stabilizer containing both iron ions and thiosulfates, it has been found that the precipitation of iron ions by the aerial oxidation of thiosulfates with iron ions as a catalyst and by the action of iron bacteria, the decomposition of thiosulfates by the action of sulfur bacteria, and the turbidity and formation of mold due to bacteria colonies are mainly responsible for the formation of precipitates. Accordingly it has been found that the stability of the washing water or stabilizer can be increased by killing the bacteria or mold in the washing water or stabilizer. Based on these findings, various antibacterial agents and antifungal agents have been investigated, and, as a result, it has been found that cmpounds of formula (I) improve the stabilization of the washing water or stabilizer.

Representative examples of the compounds of formula (I) are shown below, although the present invention is not limited thereto.

I-1

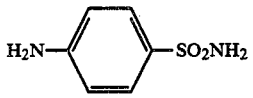

I-2

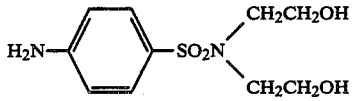

I-3

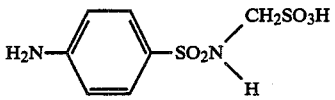

I-4

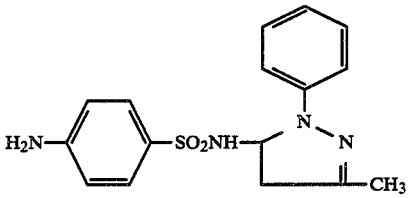

I-5

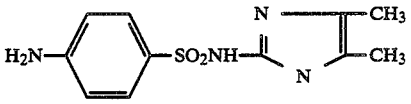

I-6

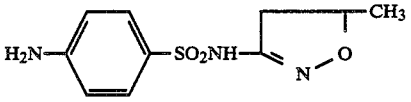

-continued

I-7

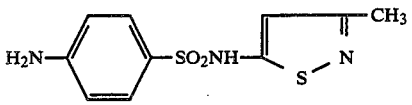

I-8

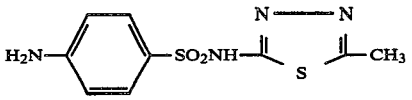

I-9

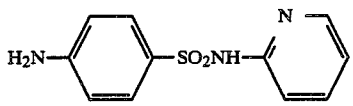

I-10

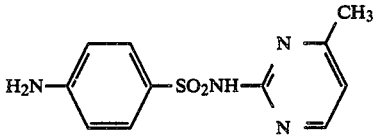

The compounds of formula (I) are known in the art and are readily available. Some of them are commercially marketed. They can be easily prepared by the methods described in H. Rapoport and J. Carson, *LABORATORY TEXT IN ORGANIC CHEMISTRY*, 3RD ed., Prentice Hall Inc., page 202 (1970).

The amount of the compound of formula (I) used is preferably from $1\times10^{-5}$ to 1.0 mol, and more preferably from $1\times10^{-4}$ to $2\times10^{-2}$ mol, per liter of the washing water or stabilizer.

In the washing water or stabilizer are inevitably brought iron salts as the bleaching component and thiosulfates as the fixing component from the preceding bath (bleaching bath, fixing bath, and bleach-fixing bath) during the processing. The concentrations of these ingredients vary depending on the particular washing or stabilization steps used. In general, the iron content is from $1\times10^{-6}$ to $1\times10^{-1}$ mol/l, and preferably from $1\times10^{-5}$ to $5\times10^{-2}$ mol/l, and the thiosulfate content is from $1\times10^{-4}$ to $5\times10^{-1}$ mol/l, and preferably from $1\times10^{-3}$ to $3\times10^{-1}$ mol/l.

To the washing water or stabilizer of the present invention, other antibacterial agents and antifungal agents (biocides) can be added in combination with the compounds of formula (I). Typical examples of antifungal agents which can be used in combination with the compounds of formula (I) are described below.

Thiazolylbenzimidazole compounds as described, for example, in Japanese Patent Application (OPI) Nos. 157244/82 and 105145/83, isothiazolone compounds as described, for example, in Japanese Patent Application (OPI) No. 8542/82, chlorophenol compounds such as trichlorophenol, bromophenol compounds, organotin or organozinc compounds, thiocyanic acids or isothianic acids, acid-amides, diazine or triazine compounds, thiourea compounds, alkylguanidine compounds, quaternary ammonium salts such as benzalkonium chloride, sulfite compounds, and antibiotics such as penicillin.

Of the above compounds, thiazolylbenzimidazole and isothiazolone compounds are preferably used in combination with the compounds of formula (I).

In addition, various other compounds may also be added to the washing water of the present invention. For example, if desired, hardening agents (e.g., magnesium and aluminum salts), surface active agents to prevent drying load and unevenness, brightening agents to increase the degree of whiteness, sulfites as preservatives, and bismuth salts to accelerate chelating with iron can be added. Compounds as described in L. E. West, *Phot. Sci. and Eng.*, Vol. 9, No. 6 (1965), "Water Quality Criteria", may also be added.

It is preferred that various chelating agents be used in combination with the compounds of formula (I). Chelating agents which can be used in combination include inorganic phosphoric acid-, organic carboxylic acid-, aminopolycarboxylic acid-, phosphonocarboxylic acid-, alkylphosphonic acid-, and aminopolyphosphonic acid-based compounds. Of these compounds, ethylenediaminetetraacetic acid, hydroxyethylethylenediaminetriacetic acid, 1,2-diaminopropane-N,N,N',N'-tetraacetic acid, 1-hydroxyethylidene-1,1 -diphosphonic acid, nitrilo-N,N,N-trimethylenephosphonic acid, and ethylenediamine-N,N,N',N'-tetramethylenephosphonic acid are preferably used in combination with the compounds of formula (I). Particularly preferred are ethylenediaminetetraacetic acid and 1-hydroxyethylidene-1,1-diphosphonic acid.

The amount of the chelating agent added is generally from $1\times10^{-5}$ to $1\times10^{-1}$ mol, and preferably from $1\times10^{-4}$ to $1\times10^{-2}$ mol per liter of the washing water.

It is preferred in the present invention to employ the countercurrent washing method utilizing 2 to 5 vessels or washing tanks in view of the object of decreasing the amount of water used. The necessary amount of washing water for this case is from about 50 to 1,000 ml per square meter of the color light-sensitive material. The amount of washing water used varies with the number of the washing tanks; the exact amount can be calculated based on the above-described reference, S. R. Godwasser, *SMPTE*, 64, pp. 248–253 (May 1955), "Water Flow Rates in Immersion-Washing of Motion Picture Film".

The pH of the washing water in the method of the present invention is usually about 7 but sometimes varies within the pH range of from 3 to 9 due to ingredients carried over from the preceding bath. The washing temperature is generally from 5 to 50° C., and preferably from 10 to 35° C. If necessary, a heater, a temperature controller, a circulation pump, a filter, a floating cover, a squeeze, etc., may be provided in the inside of the washing tank.

In the method of the present invention, the light-sensitive material may be stabilized after being washed, or immediatey stabilized without washing.

As the stabilizer to be used in the stabilization step, a processing solution to stabilize dye images can be used. Typical examples of such processing solutions are those having a buffer capacity within the range of pH 3–6, and those containing aldehyde such as formalin.

Various compounds as described above, which are to be added to the washing water, may also be added to the stabilizer, if desired.

It is preferred in the present invention to employ a multistage countercurrent stabilization method utilizing 2 to 5 tanks in view of the object of decreasing the amount of the stabilizer. The necessary amount of the stabilizer is from about 50 to 1,000 ml per square meter of the color light-sensitive material.

The temperature of the stabilizer is generally from 5 to 40° C., and preferably from 10 to 35° C. If necessary, a heater, a temperature controller, a circulation pump, a filter, a floating cover, a squeeze, etc., may be provided in the inside of the stabilization tank.

The method of the present invention can be applied to any of commonly used silver halide color photographic light-sensitive materials such as a color negative film, a color paper, a color positive film, and a color reversal film. Preferably it is applied to color paper and color negative film.

Typical development processing schemes within the scope of the present invention are shown below, although the invention is not limited thereto.

A. (Color development)—(bleach-fixing)—(washing-)—(drying)

B. (Color development)—(bleach-fixing)—(washing-)—(stabilization)—(drying)

C. (Color development)—(washing)—(bleach-fixing-)—(washing)—(drying)

D. (Color development)—(bleaching)—(fixing)—(-washing)—(stabilization)—(drying)

E. (Color development)—(bleaching)—(fixing)—(-washing)—(drying)

F. (Color development)—(washing)—(bleaching)—(-fixing)—(washing)—(drying)

In schemes B and D, "washing" as a bath preceding "stabilization" may be omitted.

The color developer that is used in the present invention contains a color developing agent. Preferred examples of the color developing agent are p-phenylenediamine derivatives. Typical examples are shown below, although the present invention is not limited thereto.

D-1 N,N-Diethyl-p-phenylenediamine
D-2 2-Amino-5-diethylaminotoluene
D-3 2-Amino-5-(N-ethyl-N-laurylamino)toluene
D-4 4-[N-Ethyl-N-(β-hydroxyethyl)amino]aniline
D-5 2-Methyl-4-[N-ethyl-N-(β-hydroxyethyl-)amino]aniline
D-6 N-Ethyl-N-(β-methanesulfonamidoethyl)-3-methyl-4-aminoaniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline These p-phenylenediamine derivatives may be used in the form of salts such as sulfates, hydrochlorates, sulfites, and p-toluenesulfonates. Such compounds are described, for example, in U.S. Pat. Nos. 2,193,015, 2,552,241, 2,566,271, 2,592,364, 3,656,950 and 3,698,525. The amount of the aromatic primary amine developing agent used is from about 0.1 to 20 g, and preferably from about 0.5 to 10 g, per liter of the developer.

The color developer that is used in the present invention, as is well known, may contain hydroxylamines. These hydroxylamines can be used in the color developer in the form of free amines. In general, however, they are used in the form of water-soluble acid salts, such as sulfates, oxalates, chlorides, phosphates, carbonates, and acetates. The hydroxylamines may be substituted or unsubstituted, and may be substituted by an alkyl group in the nitrogen atom thereof.

The pH of the color developer is preferably from 9 to 12, and more preferably from 9 to 11.0. The color developer may contain other developing ingredients. For example, as alkali agents, caustic soda and caustic potash can be added, and as pH buffers, sodium carbonate, potassium carbonate, sodium triphosphate, potassium triphosphate, potassium metaborate and borax can be added. The alkali agent and pH buffer each can be used alone or as mixtures thereof. For the purpose of imparting a buffer capacity or increasing an ion strength, or for the convenience of preparation of the color developer, salts such as di-sodium or potassium hydrogenphosphate, potassium or sodium dihydrogenphosphate, sodium or potassium bicarbonate, boric acid, alkali nitrates, and alkali sulfates can be added.

In addition, various chelating agents can be added to the color developer for the prevention of precipitation of calcium and magnesium. For example, polyphosphoric acid salts, aminopolycarboxylic acids, phosphonocarboxylic acids, aminopolyphosphonic acids, and 1-hydroxyalkylidene-1,1-diphosphonic acid can be used.

If desired, development accelerators can be added to the color developer. Development accelerators which can be used include cationic compounds such as pyridinium compounds; cationic dyes such as phenosafranine; neutral salts such as thallium nitrate and potassium nitrate as described in U.S. Pat. Nos. 2,648,604 and 3,171,247, and Japanese Patent Publication No. 9503/69; nonionic cmpounds such as polyethylene glycol and its derivatives, and polythioethers as described in Japanese Patent Publication No. 9304/69, U.S. Pat. Nos. 2,533,990, 2,531,832, 2,950,970, and 2,577,127, and thioether compounds as described in U.S. Pat. No. 3,201,242.

Moreover, sodium sulfite, potassium sulfite, potassium bisulfite, and sodium bisulfite, which are commonly used as preservatives, can be added.

If desired, antifoggants can be added to the color developer of the present invention. Antifoggants which can be used include alkali metal halides such as potassium bromide, sodium bromide, and potassium iodide, and organic antifoggants. Typical examples of organic antifoggants which can be used are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, and hydroxyazaindolizine; mercapto-substituted heterocyclic compounds such as 1-phenyl-5-mercaptotetrazole, 2-mercaptobenzimidazole, and 2-mercaptobenzothiazole, and mercapto-substituted aromatic compounds such as thiosalicylic acid. Particularly preferred are nitrogen-containing heterocyclic compounds. These antifoggants may come from the color light-sensitive material and accumulate in the color developer during the processing.

The bleaching solution or bleach-fixing solution which is used in the present invention contains an iron complex as a bleaching agent. A preferred example of such iron complexes is an aminopolycarboxylic acid/iron complex. The amount of the bleaching agent added is generally from 0.01 to 1.0 mol/l, and preferably from 0.05 to 0.50 mol/l.

The fixing or bleach-fixing solution contains a thiosulfate as a fixing agent. A preferred example of such thiosulfates is ammonium thiosulfate. The amount of the fixing agent added is from 0.1 to 5.0 mol/l, and preferably from 0.5 to 2.0 mol/l.

As preservatives, sulfites are commonly used. In addition, ascorbic acid, carbonyl/bisulfite adducts, or carbonyl compounds may be added. If necessary, buffers, brightening agents, chelating agents, antifungal agents, etc., may be added.

As accelerators for the bleaching or bleach-fixing solution, as well as bromine and iodine ions, thiourea compounds as described in U.S. Pat. No. 3,706,561, Japanese Patent Publication Nos. 8506/70, 26586/74, Japanese Patent Application (OPI) Nos. 32735/78, 36233/78, and 37016/78, thiol compounds as described in Japanese Patent Application (OPI) Nos. 124424/78, 95631/78, 57831/78, 32736/78, 65732/78, 52534/79, and U.S. Pat. No. 3,893,858, heterocyclic compounds as described in Japanese Patent Application (OPI) Nos. 59644/74, 140129/75, 28426/78, 141623/78, 104232/78, 35727/79, and *Research Disclosure*, No. 17129, thioether compounds as described in Japanese Patent Application (OPI) Nos. 94927/78, 20832/77, 37418/78, 95630/78, 25064/80, and 26506/80, quaternary amines as described in Japanese Patent Application (OPI) No. 84440/73, and thiocarbamoyl compounds as described in Japanese Patent Application (OPI) No. 42349/74 can be used.

The present invention is described in greater detail by reference to the following examples.

EXAMPLE 1

A color negative film, HR-100 produced by Fuji Photo Film Co., Ltd. (24 exposures) was exposed imagewise and then continuously processed by a procedure as shown below in Table 1 by the use of a Fuji color negative processor, FP-500, produced by Fuji Photo Film Co., Ltd.

TABLE 1

| Step | Test min. sec. | Temperature (°C.) | Tank Capacity (l) | Amount Replenished (ml/24 exposure roll of film) |
|---|---|---|---|---|
| Color development | 3' 15" | 38 ± 0.3 | 21 | 45 |
| Bleaching | 4' 20" | 38 ± 3 | 18 | 20 |
| Fixing | 3' 15" | 38 ± 3 | 18 | 39 |
| Washing (1) | 1' 30" | 33 ± 3 | 8 | — |
| Washing (2) | 2' 00 | 33 ± 3 | 8 | 20 |
| Stabilization | 40" | 38 ± 3 | 13 | 39 |

A two-stage countercurrent washing from the washing (2) to the washing (1) was employed.

The amount of the processing solution brought into each tank from the preceding tank was about 2 ml per film (24 exposures).

The compositions of the tank solutions and replenisher for each step are shown below.

| Color Developer | Tank Solution | Replenisher |
|---|---|---|
| Sodium nitrilotriacetate | 1.0 g | 1.1 g |
| Sodium sulfite | 4.0 g | 4.4 g |
| Sodium carbonate | 30.0 g | 32.0 g |
| Potassium bromide | 1.4 g | 0.7 g |
| Hydroxyamine sulfate | 2.4 g | 2.6 g |
| 4-(N—Ethyl-N—β-hydroxyethylamino)-2-methylaniline sulfate | 4.5 g | 5.0 g |
| Water to make | 1 liter | 1 liter |
| pH | 10.00 | 10.05 |

| Bleaching Solution | Tank Solution | Replenisher |
|---|---|---|
| Ammonium bromide | 160.0 g | 176 g |
| Aqueous ammonia (28%) | 25.0 g | 15 g |
| Sodium iron ethylenediaminetetraacetate | 130.0 g | 143 g |

-continued

| Bleaching Solution | Tank Solution | Replenisher |
|---|---|---|
| Glacial acetic acid | 14.0 ml | 14.0 ml |
| Water to make | 1 liter | 1 liter |
| pH | 6.0 | 5.7 |

| Fixing Solution | Tank Solution | Replenisher |
|---|---|---|
| Sodium tetrapolyphosphate | 2.0 g | 2.2 g |
| Sodium sulfite | 4.0 g | 4.4 g |
| Ammonium thiosulfate (70%) | 175.0 ml | 193.0 ml |
| Sodium bisulfite | 4.6 g | 5.1 g |
| Water to make | 1 liter | 1 liter |
| pH | 6.6 | 6.6 |

| Stabilizer | Tank Solution | Replenisher |
|---|---|---|
| Formalin (37 wt % formaldehyde solution) | 8.0 ml | 8.0 ml |
| Driwel (produced by Fuji Photo Film Co., Ltd.) | 4.0 ml | 4.0 ml |
| Water to make | 1 liter | 1 liter |

Forty exposed negative films per day were processed under the above conditions, and this processing was continued for 60 days. The number of days until floating matter and precipitate were formed in the washing tanks (1) and (2) was measured, and the results are shown in Table 2 below. Similarly, the number of days was measured in cases that various compounds were added to the washing water (tank solution and replenisher, and the results are shown in Table 2. In Table 2, the symbol O indicates that even though the processing was continued for 60 days, no floating matter or precipitate were formed.

TABLE 2

| Run No. | Washing Conditions Compound Added Type | Amount (mol/l) | pH of Washing Water* | Washing (1) (days) | Washing (2) (days) | Remarks |
|---|---|---|---|---|---|---|
| 1 | — | — | 7.0 | 14 | 7 | Comparative Example |
| 2 | Sodium dehydroacetate | $5 \times 10^{-4}$ | " | 20 | 11 | " |
| 3 | 2-(4-Triazolyl)-benzimidazole*1 | $1 \times 10^{-4}$ | " | 23 | 11 | " |
| 4 | 1-Hydroxyethylidene-1,1-diphosphonic acid*2 | $5 \times 10^{-4}$ | " | 30 | 22 | " |
| 5 | Potassium sorbate | " | " | 17 | 10 | " |
| 6 | I-1 | " | " | O | 35 | Example of the invention |
| 7 | I-1 | " | " | O | O | " |
| | Ethylenediamine-N,N,N',N'—tetramethylenephosphonic acid | " | | | | |
| 8 | I-1 | " | " | O | O | " |
| | 1-Hydroxyethylidene-1,1-diphosphonic acid | " | | O | O | |
| 9 | I-1 | " | " | O | O | " |
| | Ethylenediaminetetraacetic acid | | | | | |
| 10 | Ethylenediaminetetraacetic acid | " | " | 35 | 25 | Comparative Example |
| 11 | Ethylenediamine-N,N,N',N'—tetramethylenephosphonic acid | " | " | 35 | 25 | " |

Note:
pH of washing water: adjusted with KOH or $H_2SO_4$.
*1Compound disclosed in Japanese Patent Application (OPI) No. 157244/82
*2Compound disclosed in Japanese Patent Application (OPI) No. 8543/82

In accordance with the method of the present invention (Run Nos. 6, 7, 8, 9, 10, and 11), the stability of washing water was greatly increased in both the washing steps (1) and (2).

EXAMPLE 2

A color paper produced by Fuji Photo Film Co., Ltd. was exposed imagewise and then continuously processed with a Fuji color paper processor FMPP-1000 produced by Fuji Photo Film Co., Ltd. according to the procedure set forth in Table 3.

TABLE 3

| Step | Time min. sec. | Temperature (°C.) | Tank Capacity (l) | Amount Replenished (ml/m²) |
|---|---|---|---|---|
| color Development | 3' 30" | 38 ± 0.3 | 88 | 161 |
| Bleach-Fixing | 1' 30" | 33 ± 3 | 35 | 60 |
| Washing (1) | 40" | 33 ± 3 | 17 | — |
| Washing (2) | 40" | 33 ± 3 | 17 | — |
| Washing (3) | 40" | 33 ± 3 | 17 | 250 |

A three-stage countercurrent washing from the washing (3) to the washing (1) was employed.

The amount of the processing solution brought into each tank from the preceding tank was about 60 ml per square meter of the color paper.

The compositions of the tank solution and replenisher at each step are shown below.

| Color Developer | Tank Solution | Replenisher |
|---|---|---|
| Water | 800 ml | 800 ml |
| Trisodium nitrilotriacetate | 2.0 g | 2.0 g |
| Benzyl alcohol | 14 ml | 18 ml |
| Diethylene glycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| N—Ethyl-N—(β-methanesulfona, odpetju;)-3-methyl-4-aminoaniline sulfate | 5.0 g | 8.0 g |
| Water to make | 1,000 ml | 1,000 ml |
| pH | 10.15 | 10.65 |

| Bleach-Fixer | Tank Solution | Replenisher |
|---|---|---|
| Water | 400 ml | 400 ml |
| Ammonium thiosulfate (70% solution) | 150 ml | 300 ml |
| Sodium sulfite | 18 g | 36 g |
| Iron (III) ammonium ethylenediamineacetate | 55 g | 110 g |
| Disodium ethylenediamine-tetraacetate | 5 g | 10 g |
| Water to make | 1,000 ml | 1,000 ml |
| pH | 6.70 | 6.50 |

Ten square meters of the color paper per day was processed under the above conditions, and this processing was continued for 60 days. The number of days until floating matter and precipitate were formed in the washing tanks (1), (2), and (3) was measured, and the results are shown in Table 4. Similarily, the number of days was measured in cases that various compounds were added to the washing water (tank solution and replenisher), and the results are shown in Table 4.

The symbol O in the table is the same as defined in Example 1.

TABLE 4

| Run No. | Compound Added | Washing Conditions: Amount (mol/l) | pH of Washing Water* | Washing (1) (days) | Washing (2) (days) | Washing (3) (days) | Remarks |
|---|---|---|---|---|---|---|---|
| 12 | — | — | 7.0 | 16 | 10 | 5 | Comparative example |
| 13 | Sodium dehydroacetate | $5 \times 10^{-3}$ | " | 20 | 12 | 7 | " |
| 14 | Potassium soribate | " | " | 16 | 10 | 6 | " |
| 15 | 2-(4-Thiazolyl)-benzimidazole*1 | $1 \times 10^{-4}$ | " | 35 | 19 | 15 | " |
| 16 | 1-Hydroxyethylidene-1,1-diphosphate*1 | $5 \times 10^{-3}$ | " | 45 | 25 | 18 | " |
| 17 | I-1 | " | " | O | O | 34 | Example of the invention |
| 18 | I-1<br>1-Hydroxyethylidene-1,1-diphosphate | "<br>" | " | O | O | O | " |
| 19 | I-1<br>5-Chloro-2-methyl-4-isothiazoline-3-one | "<br>" | " | O | O | O | " |
| 20 | I-1<br>Nitrilo-N,N,N-trimethylene-phosphonic acid | "<br>" | " | O | O | O | " |
| 21 | Ethylenediamine-N,N,N',N'—tetramethylenephosphonic acid | " | " | 50 | 30 | 20 | Comparative example |
| 22 | I-1<br>Ethylenediamine-N,N,N',N'—tetramethylenephosphonic acid | "<br>" | " | O | O | O | Example of the invention |

Note:
pH of washing water: Adjusted with KOH or $H_2SO_4$.
*1,*2The same as defined in Table 2.

In accordance with the method of the invention (Run Nos. 17 to 20, and 22), the stability of the washing water was greatly increased in the washing steps (1), (2) and (3), and, furthermore, when the other antifungal agent or chelating agent was used in combination (Run Nos. 18 to 20), neither precipitates nor floating matter were formed even in the washing step (3), where the stability was poor, during the 60-day processing process.

While the invention has been described in detail and with reference to specific embodiments thereof, it will be apparent to one skilled in the art that various changes and modification can be made therein without departing from the spirit and scope thereof.

What is claimed is:

1. A method for continuously development processing an imagewise exposed silver halide color photographic light-sensitive material, comprising the use in a washing step or a stabilization step subsequent to bleaching and fixing steps or a bleach-fixing step of at least one compound represented by formula (I)

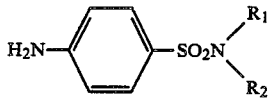

(I)

wherein $R_1$ and $R_2$ each represents a hydrogen atom, an alkyl group, a substituted alkyl group, an aryl group, a substituted aryl group, or a nitrogen-containing heterocyclic group.

2. A method as in claim 1, wherein the alkyl group or substituted alkyl group contains from 1 to 10 carbon atoms, the aryl group or substituted aryl group has from 6 to 16 carbon atoms, and the nitrogen-containing heterocyclic group is selected from a pyrazole group, an oxazole group, an isooxazole group, a thiazole group, an isothiazole group, a thiadiazole group, a pyridyl group, or a pyridazine group.

3. A method as in claim 2, wherein the alkyl group or substituted alkyl group contains from 1 to 5 carbon atoms, and the aryl group or substituted aryl group contains from 6 to 10 carbon atoms.

4. A method as in claim 1, wherein the compound of formula (I) is used in an amount of from $1 \times 10^{-5}$ to 1.0 mol per liter of solution in the washing step or the stabilization step.

5. A method as in claim 1, wherein the compound of formula (I) is used in an amount of from $1 \times 10^{-4}$ to $2 \times 10^{-2}$ mol per liter of solution in the washing step or the stabilization step.

6. A method as in claim 1, wherein $R_1$ and $R_2$ each represents a hydrogen atom, an alkyl group having 1 to 5 carbon atoms, or a substituted or unsubstituted nitrogen-containing heterocyclic group.

7. A method as in claim 1, wherein a chelating agent is further used in the washing step or a stabilization step.

8. A method as in claim 1, wherein the washing step or stabilization step is a multi-stage countercurrent washing method.

9. A method as in claim 8, wherein the multistage countercurrent washing method comprises from 2 to 5 tanks.

* * * * *